US005825273A

United States Patent [19]

Roger

[11] Patent Number: 5,825,273

[45] Date of Patent: Oct. 20, 1998

[54] DIFFERENTIAL THERMAL TRIPPING DEVICE WITH BIMETALLIC STRIPS

[75] Inventor: Patrick Roger, Auxonne, France

[73] Assignee: Schneider Electric SA, Boulogne Billancourt, France

[21] Appl. No.: 819,707

[22] Filed: Mar. 18, 1997

[30] Foreign Application Priority Data

Mar. 20, 1996 [FR] France ..... 96 03567

[51] Int. Cl.[6] ..... H01H 61/00

[52] U.S. Cl. ..... 337/49; 337/62; 337/82

[58] Field of Search ..... 337/49, 62, 3, 337/82, 333, 347

[56] References Cited

U.S. PATENT DOCUMENTS 4,528,539 7/1985 Forsell et al. ..... 337/49
4,691,184 9/1987 Wulff ..... 337/49
4,859,979 8/1989 Jacqet ..... 337/3

FOREIGN PATENT DOCUMENTS 2 666 928 3/1992 France .
WO 86/02197 4/1986 WIPO .

*Primary Examiner*—Leo P. Picard
*Assistant Examiner*—Jayprakash N. Gandhi
*Attorney, Agent, or Firm*—Oblon, Spivak, McClelland, Maier & Neustadt, P C.

[57] ABSTRACT

Differential thermal tripping device with bimetallic strips for electrical protection appliance such as a circuit breaker. The circuit breaker includes a tripping assembly with two contact strips 30, 40 free to move along the X direction, and for each bimetallic strip, a single adjustment part 15 fixed to a free inclined edge 19 of the bimetallic strip head 13, adjustable along the X direction, in the position obtained after heating of the bimetallic strips for calibration. The assembly 30, 40 may consist of a frame supporting adjustment parts until they are fixed and provided with separable areas 36, 46 to generate two contact strips following cutting.

4 Claims, 1 Drawing Sheet

DIFFERENTIAL THERMAL TRIPPING DEVICE WITH BIMETALLIC STRIPS

BACKGROUND OF THE INVENTION

1. Field of the Invention

This invention relates to a differential thermal tripping device for an electrical switching appliance, particularly for a circuit breaker, comprising tripping assembly with two adjustable contact strips installed parallel to each other and associated with a tripping mechanism, and several bimetallic strips with opposite faces that come into contact with each of the two contact strips through intermediate adjustment elements, so that a concomitant or different deflection of the bimetallic strips will cause a simultaneous or differential displacement of the contact strips.

2. Description of the Related Art

This type of tripping device is known and is described in document FR-2 666 928. This document describes a process for adjusting the tripping distances of the bimetallic strips by using a single part for contact strips, then by disassociating the connecting areas specific to this part at locations determined by measuring the deflection of the bimetallic strips that cause tripping.

Furthermore, another known procedure is to associate adjusting parts with contact strips that are moved by bimetallic strips during the tripping device calibration operation, the position of the elements being fixed on the contact strips in the required position by welding or gluing. According to document WO-86 02197, an adjustment part is provided for each bimetallic strip, and is housed in a slit that opens up near the end of the bimetallic strip. However, positioning the adjustment part in the slit causes jamming and does not facilitate welding, particularly when it is done by a laser beam.

SUMMARY OF THE INVENTION

The purpose of this invention is to provide a simple and in situ adjustment of the distance moved by the bimetallic strips in the described type of tripping device, avoiding risks of jamming and facilitating the operation of attaching adjustment parts.

According to the invention, before being fixed the adjustment part is placed so that it can slide freely on an inclined edge away from the head of the bimetallic strip, being held vertically in place on the contact strips. Due to the edge inclination, the adjustment part can position itself vertically on the edge thus facilitating its attachment, particularly by a laser welding beam.

Preferably, the two contact strips in the tripping assembly are obtained by cutting separable areas of an installation frame; and include recesses facing each other for adjustment parts, these recesses being laid out to keep the adjustment parts in contact with the bimetallic strips in an inclined position until they are fixed to the bimetallic strips.

BRIEF DESCRIPTION OF THE DRAWINGS

The following description of an embodiment of this invention relates to the appended figures, and illustrates its advantages and results in more detail.

DESCRIPTION OF THE PREFERRED EMBODIMENT

Figure 1:
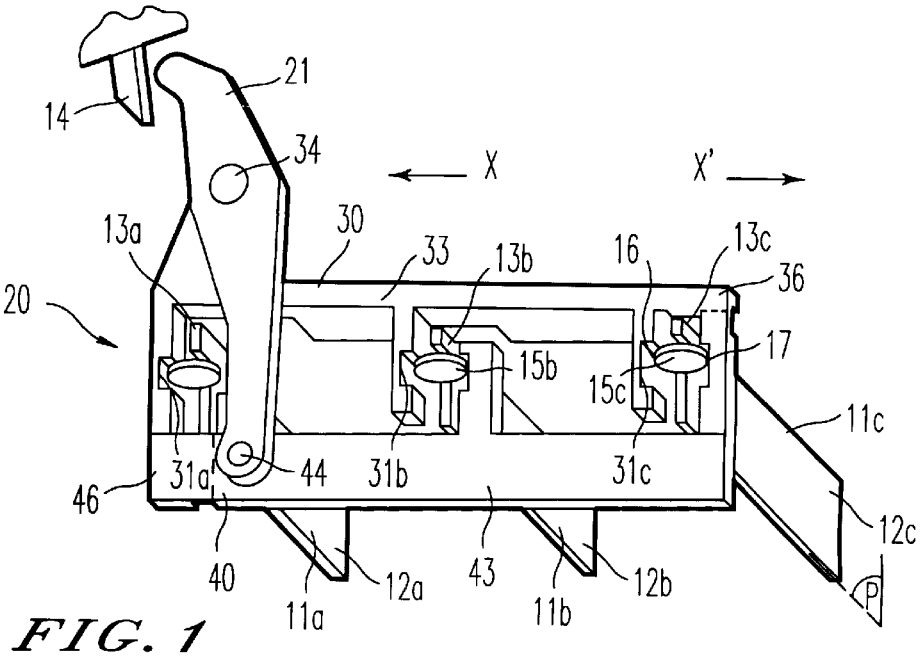
FIG. 1 shows a perspective of a differential thermal tripping device according to the invention.

The differential thermal tripping device 10 is designed to be included in an electrical protection device such as a circuit breaker-motor, a contactor-circuit breaker or a thermal relay for example a three-pole relay, in order to protect a load against overcurrents or phase unbalances.

In this case, it includes three bimetallic strips 11*a*, 11*b*, 11*c* formed of flat elongated elements of which the stands 12*a, b, c* are mounted fixed on the appliance and in which the heads 13*a, b, c* are capable of moving along a direction X as a function of the temperature rise to which they are subjected; this temperature rise results from the current passing through the various phase conductors (not shown) or the bimetallic strips themselves. The tripping device also contains a tripping assembly 20 fitted with two contact strips 30, 40 free to move in the X direction and acting as devices detecting concomitant or differentiated displacement of the bimetallic strips. In the X direction, the contact strip 30 comprises stop surfaces 31*a, b, c* that may be contacted by each of the bimetallic strips, these surfaces 31 being placed on arms 32*a, b, c*, perpendicular to a rod 33 on the contact strip oriented along the X direction; similarly, the contact strip 40 comprises stop surfaces 41*a, b, c*, that may be contacted by bimetallic strips in the X' direction opposite to X and fitted on arms 42*a, b, c* perpendicular to a rod 43 on the contact strip along the X direction. A lever 21 is hinged onto contact strips 30, 40 at points 34, 44 and acts on a tripping mechanism 14, for which only the control element is shown on the figure. The device that has been described above, and its method of operation, is well known to those skilled in the art; when the bimetallic strips act in exactly the same way under a temperature rise due to an overcurrent, they pull contact strip 30 and contact strip 40 through lever 21, but there is no relative displacement between contact strip 40 and contact strip 30; when the bimetallic strips react differently to applied thermal loads, the motion of the contact strip 40 along X is limited by one of the bimetallic strips, such that the relative displacement between the contact strips cause an anticipating rotation of the lever.

According to the invention, there is an adjustment part 15*a, b, c*, at the head 13 of each bimetallic strip 11, in this example formed by a disk (see figures) but which could also be a needle or another similar element. Each disk 15 cooperates through end 16 or 17 with a stop surface 31, 41 of a contact strip 30, 40 respectively.

Figure 2:
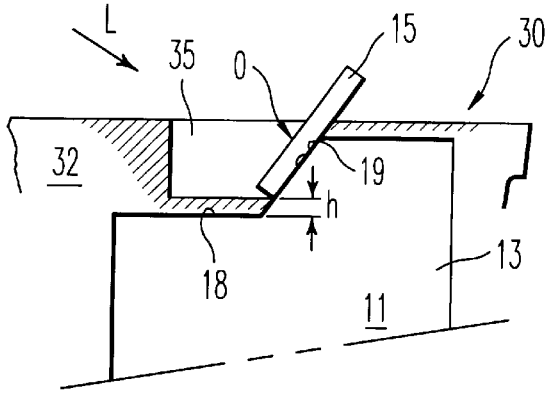
FIG. 2 schematically represents a top view of the tripping device in FIG. 1 after the bimetallic strip adjustment disks have been fixed.
Figure 3:
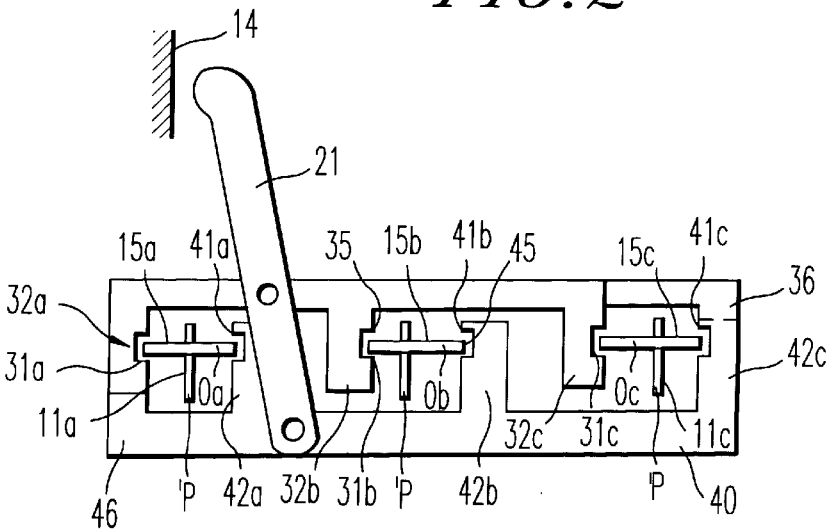
FIG. 3 shows an elevation of a bimetallic strip head with the adjusting disk associated with it.

Before the adjustment operation, the disks are carried by contact strips in side recesses 35, 45 formed in the arms 32, 42 of the contact strips, the contact strips initially being assembled or formed in a single rectangular frame 30, 40, being kept at a small distance h above an upper horizontal edge 18 of the head 13 of the bimetallic strips and in contact with a vertical or inclined edge 19 of the head 13, so that they can slide freely on this edge, to be positioned at a height above it and so that they can move laterally without getting jammed. The frame 30, 40 includes weakened areas 36, 46 at two opposite corners, which will enable separation by cutting after adjustment. During calibration, following a predetermined temperature rise in the bimetallic strips, the bimetallic strips will bend and their heads will move along the X direction relative to frame 30, 40; at the obtained adjustment position, the center O of the disk coincides with the average plane P of the bimetallic strip, which is more or less offset from this plane (see FIG. 2). Disk 15 is then welded in this position, for example using a laser beam L, to edge 19 of the head; this edge is preferably inclined and free to move laterally (see FIG. 3) firstly so that the disk 15 can be reliably applied by gravity in contact with the bimetallic strip at the required welding location, and secondly that an inclined laser beam source L can be positioned away from the tripping device or the appliance in which the circuit breaker is placed. Recesses 35, 45 formed in contact strip arms 32, 42 include inclined edges 37, 47 to support disks in contact with the inclined edges 19 of the bimetallic strips. As soon as the disks have been welded to the bimetallic strips, the two contact strips can be separated by cutting weakened areas 36, 46, for example by laser or by any other means.

I claim:

1. Differential thermal tripping device with bimetallic strips for a switching electrical appliance, particularly for a circuit breaker, including tripping assembly with two contact strips mounted free to move in the same direction, and associated with a tripping mechanism and several bimetallic strips with opposite faces that may be applied to either of the contact strips through a single adjustment part so that a concomitant or differentiated deflection of the bimetallic strips will cause a simultaneous or differential displacement of the contact strips, the adjustment part being fixed to the head of the bimetallic strip for each bimetallic strip, in a position that can be adjusted along the displacement direction of the contact strips and which is obtained after increasing the temperature of the bimetallic strips for calibration;

wherein the adjustment part is placed after attachment to slide freely on an inclined and free edge of the bimetallic strip head such that a gap is maintained between said adjustment part and an upper horizontal edge of said contact strip.

2. Tripping device according to claim 1, characterized in that the adjustment part is fixed to the inclined edge of the metallic strip at a small distance above its horizontal edge.

3. Tripping device according to claim 1, characterized in that the two tripping assembly contact strips are obtained by cutting separable areas of a setting frame and comprise recesses facing each other and laid out to keep the adjusting parts in the inclined position and in contact with bimetallic strips until they are attached to the bimetallic strips.

4. Tripping device according to claim 3, characterized in that the setting frame is generally rectangular, the separable areas being located at the corners of the rectangle.

* * * * *